United States Patent [19]

Washburn

[11] Patent Number: 4,664,941

[45] Date of Patent: May 12, 1987

[54] CONFINEMENT CHANNELS FOR MAGNETIC BUBBLE MEMORY DEVICES

[75] Inventor: Hudson A. Washburn, Santa Clara, Calif.

[73] Assignee: Intel Corporation, Santa Clara, Calif.

[21] Appl. No.: 573,038

[22] Filed: Jan. 24, 1984

[51] Int. Cl.[4] ..... H01F 10/02

[52] U.S. Cl. ..... 427/53.1; 427/130; 427/131; 427/132

[58] Field of Search ..... 427/127-132, 427/48, 53.1

[56] References Cited

U.S. PATENT DOCUMENTS 4,079,359 3/1978 Gergis ..... 427/128 X 4,314,894 2/1982 Schmelzer et al. ..... 427/128 X

*Primary Examiner*—Bernard D. Pianalto

*Attorney, Agent, or Firm*—Blakely, Sokoloff, Taylor & Zafman

[57] ABSTRACT

Confinement channels for magnetic bubbles are formed in a magnetic garnet layer. In the preferred embodiment, the magnetic garnet layer is etched to make it thinner than those regions not directly beneath the permalloy members. This defines channels in the garnet layer having better propagation characteristics (e.g., more garnet). This results in more reliable bubble propagation.

1 Claim, 8 Drawing Figures

REPLICATE GATE

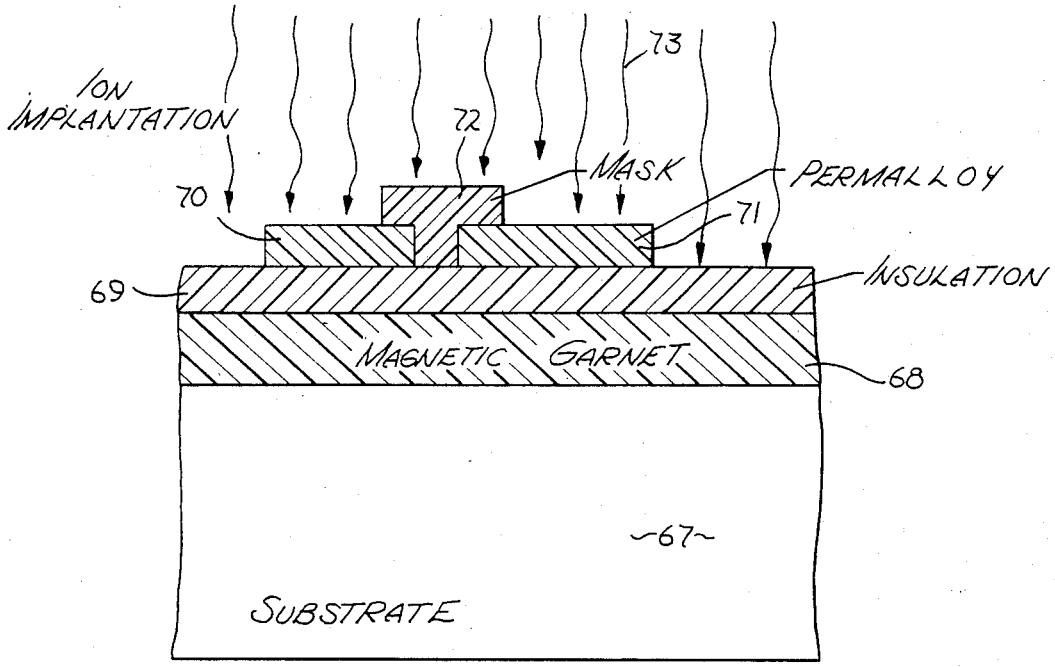
Fig. 6
Fig. 7
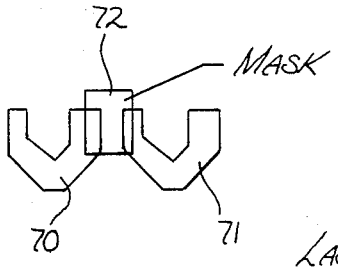
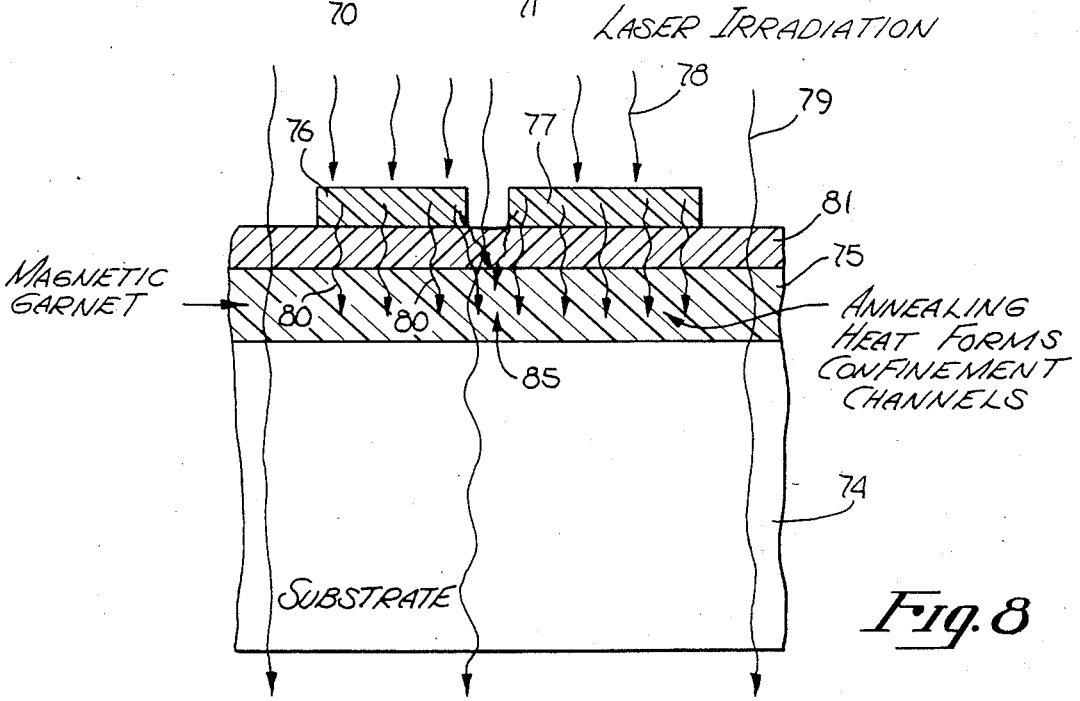
Fig. 8

CONFINEMENT CHANNELS FOR MAGNETIC BUBBLE MEMORY DEVICES

BACKGROUND OF THE INVENTION

1. Field of the Invention

The invention relates to the magnetic bubble memory devices.

2. Prior Art

Magnetic bubble memory devices for storing digital information are commercially available, for instance, from Intel Corporation. Generally, these devices employ a garnet substrate on which a magnetic garnet layer is formed in an epitaxial process. Permalloy members define localized magnetic fields under the influence of a rotating magnetic field causing the bubbles to move in the epitaxial layer. The permalloy members are fabricated over, and insulated from, the epitaxial layer. An intermediate layer of conductors, where needed, are also used for replicate gates, detectors, etc.

One failure mode in magnetic bubble memory devices occurs when a bubble slips or jumps, that is, when it does not move as intended. For example, a bubble, instead of following along a line of propagators, may jump to another line; or, instead of propagating from one chevron to the next, may slip backwards. The physical relationship between the permalloy members and the epitaxial layer, the magnetic field strength, and the shape of the permalloy members themselves, are some of the factors determining the reliability of the bubble propagation within the epitaxial layer. It is known, for instance, that by increasing the magnitude of the rotating magnetic field, more reliable propagation occurs, however, this requires additional power.

Other improvements have been suggested for improving bubble reliability. For example, in copending application, Ser. No. 483,914, filed Apr. 11, 1983, entitled "Method for Selecting Propagation Elements for Magnetic Bubble Memory", and assigned to the assignee of the present invention, differently shaped propagation elements are used for moving bubbles in opposite directions. This compensates for an asymmetry in crystal orientation in the epitaxial layer. Another suggestion has been to use different thicknesses of insulation between the permalloy elements and epitaxial layer to improve the magnetic coupling between the elements and the bubbles.

As will be seen, the present invention is directed to improving the reliability of bubble propagation in the epitaxial layer. Confinement channels are defined within the epitaxial layer to better confine the bubbles to predetermined propagation paths.

SUMMARY OF THE INVENTION

An improvement in a magnetic bubble memory device which includes a substrate, magnetic garnet layer in which magnetic bubbles are propagated and overlying permalloy members (propagation elements) is described. Confinement channels are formed in the magnetic garnet layer to confine the magnetic bubbles to predetermined propagation paths. The confinement channels are formed directly beneath the permalloy members. One of several processes is used for improving the magnetic characteristics in the garnet layer beneath these members; the other regions of the garnet layer, for instance, those between lines of propagation elements have inferior magnetic characteristics. In the presently preferred process for forming the confinement channels masking members are defined on the garnet layer at the locations below the permalloy members. The layer is then subjected to a plasma etch which thins the exposed magnetic garnet. In subsequent processing the propagation elements are formed over the confinement channels (i.e., thicker regions of the garnet layer). A metal alignment marker is fabricated on the magnetic garnet layer to allow subsequent alignment of the permalloy members to the underlying confinement channels.

BRIEF DESCRIPTION OF THE DRAWINGS

FIG. 6 is a cross-sectional elevation view of a garnet substrate, magnetic garnet layer and overlying permalloy members. This figure is used to describe another process for forming the confinement channels of the present invention.

FIG. 7 is a plan view of the structure of FIG. 6.

FIG. 8 is a cross-sectional elevation view of a garnet substrate, magnetic garnet layer and overlying permalloy members. This figure is used to describe still another process for forming the confinement channels of the present invention.

DETAILED DESCRIPTION OF THE INVENTION

Magnetic bubble confinement channels and processes for fabricating these channels in a magnetic bubble memory device is described. In the following description, numerous specific details are set forth, such as layer thicknesses, in order to provide a thorough understanding of the present invention. It will be obvious, however, to one skilled in the art that the present invention may be practiced without these specific details. In other instances, well-known methods, processes and structures have not been shown or discussed in detail in order not to unnecessarily obscure the present invention.

Figure 1:
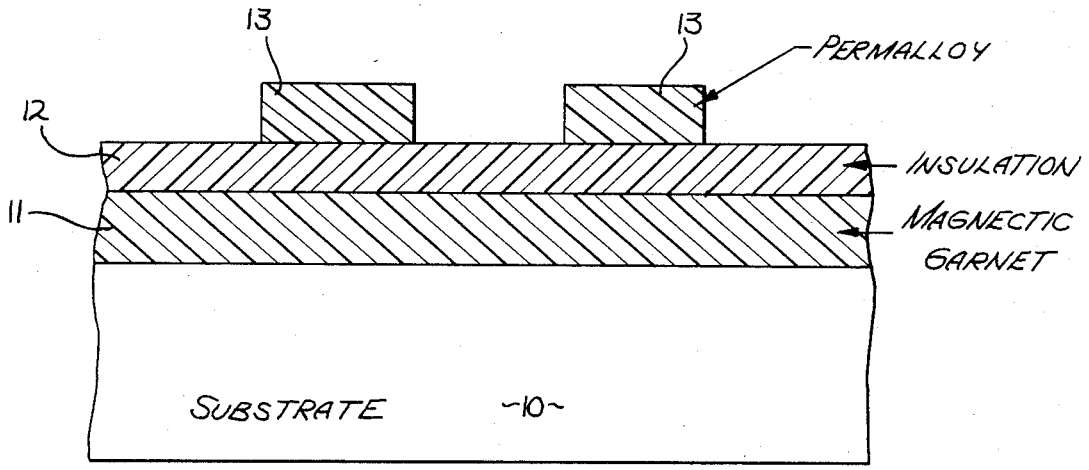
PRIOR ART Fig. 1
FIG. 1 is a cross-sectional elevation view of a portion of a magnetic bubble memory device illustrating prior art structure.

Referring to FIG. 1, in prior art magnetic bubble memory devices, the devices are generally fabricated on a garnet substrate 10, such as gadolinium gallium garnet ($Gd_3Ga_5O_{12}$). A magnetic garnet (epitaxial layer) is formed on the substrate and after ion implantation, is used for the magnetic storage layer. Permalloy members such as propagation elements 13 are formed above the magnetic garnet layer 11 and are insulated from this layer by insulative layer or layers such as a silicon dioxide layer 12. Conductors for detectors, replicate gates, and the like, are fabricated between the magnetic garnet layer and permalloy elements, these are not shown in FIG. 1. The bubbles are moved in the layer 11 in a well-known manner by an in-plane rotating magnetic field. A fixed magnetic field perpendicular to the rotating magnetic field (or slightly skewed to this perpendicular) is used in a well-known manner to maintain the bubbles in the magnetic garnet layer.

Figure 2:
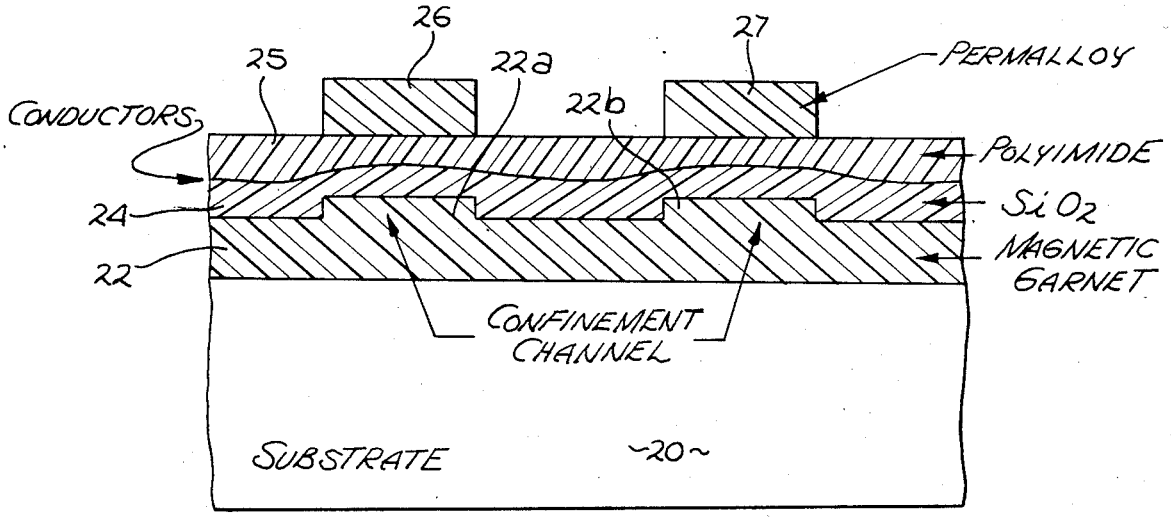
FIG. 2 is a cross-sectional elevation view of a portion of a magnetic bubble memory device fabricated in accordance with the present invention, illustrating the confinement channels in the magnetic garnet layer.

Referring to FIG. 2, with the present invention the magnetic bubble device is again formed on a garnet substrate 20 such as was the case with the prior art device of FIG. 1. An ion implanted magnetic garnet layer (epitaxial layer 22) of uniform thickness is formed on the substrate 20. Confinement channels, that is, channels in which the magnetic bubbles are to be confined are etched within the layer 22. These channels are regions having better magnetic characteristics than regions of the layer 22 surrounding the confinement channels. As is seen in FIG. 2, the confinement channels 22*a* and 22*b* are thicker than the remainder of the layer 22. Thus, even though the entire layer 22 is fabricated from a uniform magnetic garnet material and is uniformly ion implanted, improved magnetic characteristics exist within the channels 22*a* and 22*b* since it is known that magnetic bubbles will tend to stay in the thicker regions and avoid the thinner regions.

In the presently preferred embodiment a silicon dioxide layer of approximately 2000A thick is formed over the magnetic garnet layer. The conductors (where they occur in the device) are fabricated on the silicon dioxide layer 24. Then, an additional insulative layer which in the presently preferred embodiment is a polyimide layer 25 of approximately 2000A thick, is formed over the silicon dioxide layer. The permalloy members 26 and 27 are fabricated on the polyimide layer. (For a discussion of polyimide, see U.S. Pat. No. 3,179,634).

Figure 3:
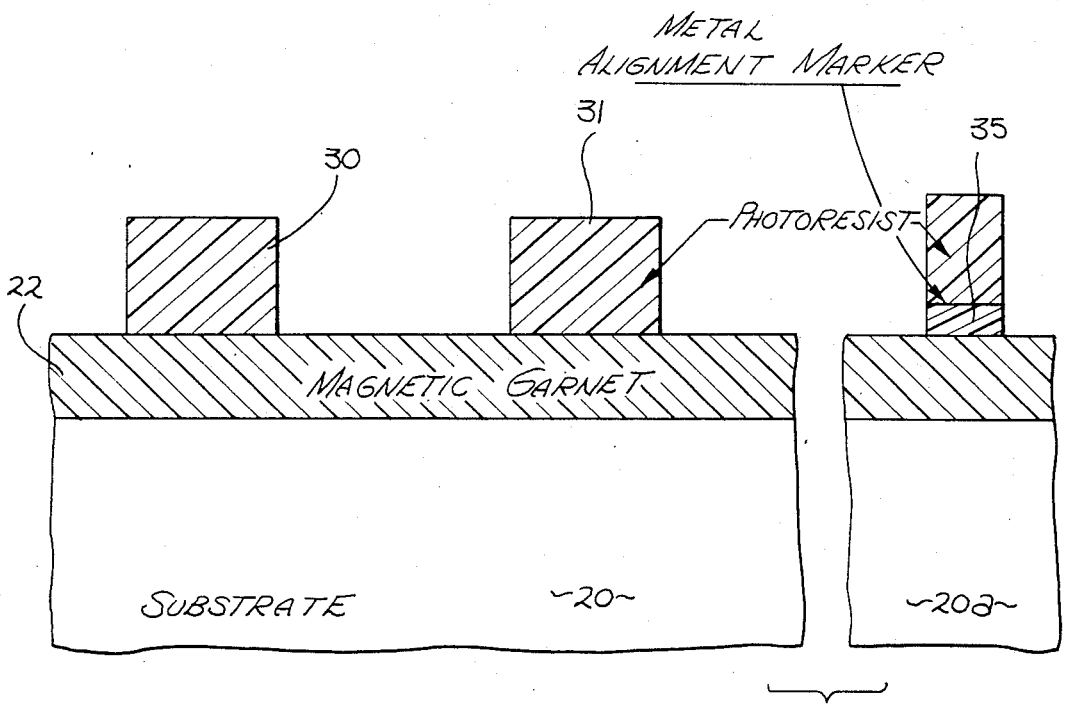
FIG. 3 is a cross-sectional elevation view of a garnet substrate, epitaxial layer and a pattern photoresist layer used to describe the formation of the confinement channels of FIG. 2.

In FIG. 3, the substrate 20 of FIG. 2 is illustrated prior to the formation of the confinement channels 22*a* and 22*b*. In the presently preferred process, a magnetic garnet layer 22 of uniform thickness (e.g., 2 microns) is formed on the substrate 20 employing an ordinary epitaxial process. Next, a metal layer is deposited on the garnet layer to allow formation of the alignment markers 35. For instance, a 1000A thick layer of permalloy, chrome, or other metal is deposited. Then the metal is removed from all areas except in the vicinity of areas where a marker will later be patterned. Two markers per device are formed on the wafer. The marker 35 as will be described in more detail is used to assure alignment between the confinement channels and the permalloy members.

Now a photoresist layer is formed on the magnetic garnet layer and is patterned to form masking members over the predetermined locations of the confinement channels and the alignment markers 35. As mentioned, the confinement channels are disposed directly beneath the permalloy member. The magnetic garnet layer 22 is etched in alignment with the members 30 and 31 to form the confinement channels 22*a* and 22*b* of FIG. 2. A plasma etch is preferred, however, a wet etchant may be employed. In the presently preferred process, the layer 22 is etched to a depth of 500A–1000A, although it is possible to etch the magnetic garnet layer 22 to a greater depth. (The confinement channels may also be formed using ion milling in alignment with the masking members 30 and 31.)

Next after removal of the masking members, the layer 22 is subjected to ion implantation of neon, and the insulative layers 24 and 25 of FIG. 2 are formed with intermediate conductors where needed. Then a permalloy layer is formed on the insulative layer 25 followed by the formation of masking members used to define the elements 26 and 27 of FIG. 2. These masking members are formed with a mask which is aligned using the metal marker 35 of FIG. 3. Since the markers of 35 are used both for the masking of both the confinement channels and the permalloy members, alignment is assured between the channels and these members. It should be noted that the confinement channels 22*a* and 22*b* are not clearly visible when masking for the permalloy members. The metal marker 35, however, can be used since it will be visible through the polyimide and silicon dioxide layers or since it will cause a sufficiently large step in these insulative layers.

Figure 4:
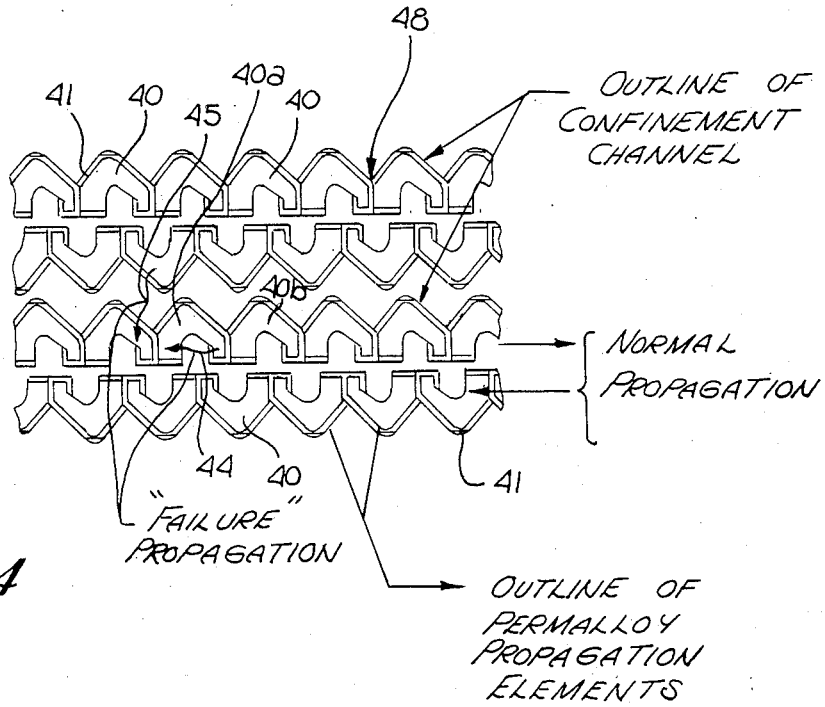
FIG. 4 is a plan view showing chevron propagation elements and the outlines of underlying confinement channels.

In FIG. 4, a plurality of permalloy members, specifically chevron propagation elements 40 are illustrated. The outline of the underlying confinement channels is shown by outline 41. In general, the confinement channels extend slightly beyond the outline of the chevrons.

Normally, a bubble will propagate, by way of example, from chevron 40*a* to chevron 40*b*. A failure occurs when a bubble fails to move from one end of chevron 40*a* onto the adjacent end of chevron 40*b*. Instead, the bubble may slip against the direction of propagation back onto the other end of chevron 40*a*, or it may strip out into a longer domain which would extend from the desired location to another chevron element. This is shown by arrow 44. With the confinement channels as described, this is less likely to occur since there is no confinement channel below the path shown by arrow 44. (The magnetic characteristics in the magnetic garnet layer 22 are less favorable below arrow 44 since the layer is thinner in this region and consequently the bubble is less likely to move in the path of arrow 44. Also, because there is no confinement channel between the lines of propagation elements, a bubble is less likely to jump from one line of propagators to another as shown by arrow 45. (This jumping, of course, constitutes a failure.) Importantly, the confinement channels are continuous along the path of propagation, and more specifically, between the chevrons in the region shown by arrow 48, thus encouraging the bubbles to move from chevron to chevron.

Figure 5:
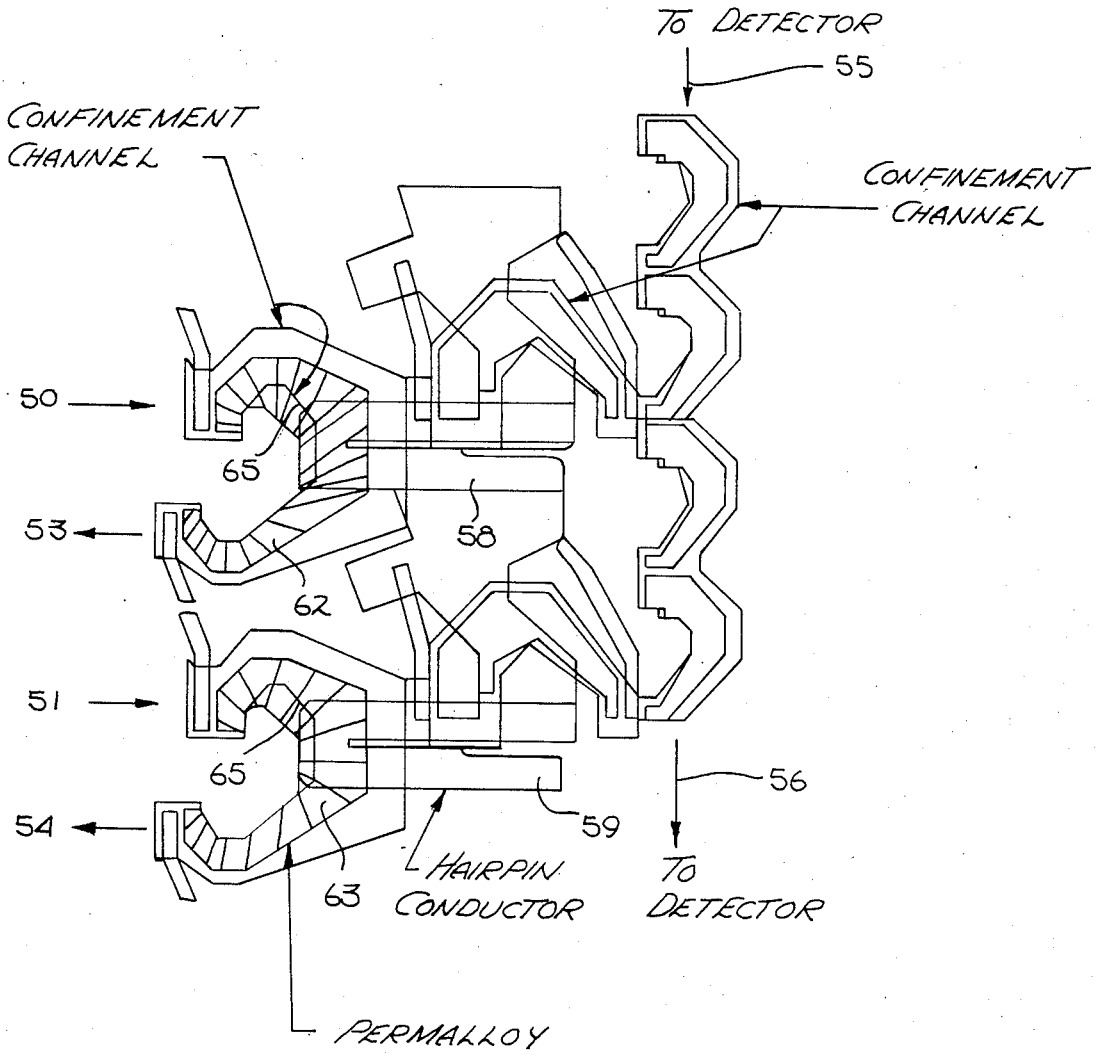
FIG. 5 is a plan view of a replicate gate which also illustrates the underlying confinement channels.

The outline of the confinement channels is relatively easy to determine for the chevron propagators shown in FIG. 4. In more complex structures, such as the replicate gates of FIG. 5, layout considerations in some cases force the confinement channels into other than the most desirable regions. The replicate gates of FIG. 5 receives bubbles on lines 50 and 51 and return the bubbles to lines 53 and 54. The bubbles are replicated on lines 55 and 56 which moves the bubbles into detectors. Well-known hairpin control lines 58 and 59 formed in the conductive layer are used to replicate the bubbles. The outlines of permalloy members 62 and 63 have been shown with cross hatching to identify them from the underlying structure. Ideally, the confinement channels should extend at least to the edge of the members 62 and 63. To facilitate layout, the confinement channels on the inner portion of elements 62 and 63 remain entirely under the propagation elements as shown by line 65.

FIG. 6 illustrates another process by which the confinement channels may be formed. An ordinary garnet substrate 67 is illustrated with an overlying magnetic garnet layer 68. This layer may be identical to layer 11 of FIG. 1, that is, an epitaxial magnetic garnet layer of uniform thickness. An insulative layer 69 is formed over the magnetic garnet layer and permalloy members, (e.g., chevrons 70 and 71) are formed on the insulative layer 69. The layer 69, members 70 and 71 are formed in an ordinary manner, such as discussed in conjunction with FIG. 1.

In FIG. 6, the permalloy members themselves are used as masking members to define the confinement channels in the layer 68. The substrate is subjected to ion implantation of hydrogen ions shown by lines 73 in FIG. 6. The ions are blockd by the permalloy members. In regions without permalloy members the hydrogen ions weaken the magnetic characteristics in the magnetic garnet layer 68. As illustrated in FIG. 7, since no permalloy is present between chevrons 70 and 71, the ions (but for the masking members 72) would be implanted between the chevrons. This would weaken the magnetic characteristics along the path of propagation. For the process shown in FIGS. 6 and 7, masking members 72 are placed between the permalloy elements in the path of propagation. This is best illustrated by the masking member 72 of FIG. 7 formed along the line of the bubble propagation between the chevrons 70 and 71. The mask 72 prevents the ions from weakening the magnetic characteristics of the garnet layer 68 along the propagation path. An ordinary masking and etching step is used to form masks 72. The masks 72 can be removed following the implant. Thus, by using the permalloy members themselves along with selective masking, confinement channels are formed in the garnet layer 68.

FIG. 8 illustrates still another process by which confinement channels can be formed. An ordinary substrate 74 is illustrated in FIG. 8 with an overlying epitaxial magnetic garnet layer 75. As was the case for the embodiment of FIG. 6, this laye may be of uniform thickness. Permalloy members 76 and 77 are formed above the magnetic garnet layer 75 on the insulative layer 81. The structure of FIG. 8 is subjected to laser irradiation. The portion of this light which is not blocked by the permalloy members passes through the substrate 74 without causing any heating as shown by rays 79. Other of this light, shown by rays 78, strikes the permalloy members and is absorbed by these members. This cause heating in the permalloy members. The permalloy members transfer heat to the magnetic garnet as shown by lines 80. The garnet material closest to the permalloy members receives more heat than, for instance, the garnet material disposed between lines of chevron elements. The heat causes annealing in the garnet layer which improves the magnetic characteristics of the garnet. Consequently, those portions of the garnet layer 75 closest to the permalloy members (since they receive more heat) have better magnetic characteristics, thereby defining the confinement channels. Note that unlike the process of FIGS. 6 and 7, masking members such as members 72 or their equivalent, are not needed. The permalloy members along the path of propagation are close enough to one another that the heat from the adjacent chevrons, for instance, in region 85 is annealed, making the confinement channel continuous along the line of propagation.

Thus, an improvement in magnetic bubble memory devices has been described. Confinement channels are formed beneath the permalloy members in the magnetic garnet layer. These channels have better magnetic characteristics than the surrounding regions of the layer. The magnetic bubbles tend to stay within the channels and do not as readily cause failures by slipping or jumping or stripping out. The invention is particularly useful for assuring that magnetic bubble memory devices which would otherwise have marginal performance, perform satisfactorily.

I claim:

1. In the fabrication of a magnetic bubble memory device which is formed on a substrate, improved processing comprising:

forming a magnetic garnet layer on said substrate;

forming an insulative layer over said magnetic garnet layer;

forming permalloy propagation members on said insulative layer;

subjecting said substrate to laser irradiation such that said propagation elements block said irradiation and become heated, said heat annealing said magnetic garnet layer beneath said members so as to form channels in said magnetic garnet layer where the magnetic characteristics is better than the magnetic characteristics in the regions of said magnetic garnet layers surrounding said channels, whereby an improved magnetic bubble memory device is formed.

* * * * *